United States Patent [19]

Takahashi

[11] Patent Number: 4,979,334

[45] Date of Patent: Dec. 25, 1990

[54] OPTICAL FIBER END-SURFACE POLISHING DEVICE

[75] Inventor: Mitsuo Takahashi, Matsudo, Japan

[73] Assignee: Seikoh Giken Co., Ltd., Chiba, Japan

[21] Appl. No.: 396,752

[22] Filed: Aug. 17, 1989

[30] Foreign Application Priority Data

Jun. 23, 1989 [JP] Japan ..... 1-159489

[51] Int. Cl.[5] ..... B24B 7/00

[52] U.S. Cl. ..... 51/120; 51/119; 51/125

[58] Field of Search ..... 51/120, 119, 125, 170 MT, 51/281 R, 283 R, 58, 60

[56] References Cited

U.S. PATENT DOCUMENTS 3,925,936 12/1975 Orlov et al. ..... 51/120

4,831,784 5/1989 Takahashi ..... 51/131.1

*Primary Examiner*—Frederick R. Schmidt

*Assistant Examiner*—M. Rachuba

*Attorney, Agent, or Firm*—Spencer & Frank

[57] ABSTRACT

An optical fiber end-surface polishing device has a polishing disc assembly which makes a polishing disc turn on its own axis and revolve around some other axis with respect to a base supporting a polishing member. There is an optical fiber holder assembly supporting an optical fiber holder section for holding a plurality of optical fibers. The optical fiber holder assembly abuts the end surfaces of the optical fibers against the polishing member while being biased in a direction perpendicular to the polishing member. The optical fiber holder assembly also has an optical fiber holder section having a disc which is provided with a plurality of optical fiber connector attaching sections to which optical fibers to be polished are attached, a supporting arm for positioning the optical fiber holder section with respect to the base, and a pressurizing shaft suspended from the supporting arm and adapted to bias the end surfaces to be polished of the optical fibers in a direction perpendicular to the polishing member.

16 Claims, 4 Drawing Sheets

OPTICAL FIBER END-SURFACE POLISHING DEVICE

BACKGROUND OF THE INVENTION

This invention relates to an optical fiber end-surface polishing device which is adapted to polish the end surfaces of a large number of optical fibers with high polishing quality.

Optical connectors are being widely used as a means for connecting optical fibers for optical communication with each other.

An optical fiber to be connected by means of an optical connector is first attached to the central hole of a ferrule by adhesion or the like. Its end surface is then polished together with that of the ferrule until it becomes a flat specular surface. Any minute flaw left on the polished end surface of an optical fiber connector will lead to an increase in connection loss.

The connection end-surface of an optical fiber connector is polished at first by being rubbed against a polishing disc surface to which a polishing medium such as an abrasive film with a relatively large grain size is bonded. The polishing is further performed in several stages, replacing the abrasive film in each stage with a new one having a smaller grain size, until a specular surface is obtained.

There may be many factors which affect the polishing quality. Experiments which have been conducted by the inventor of the present invention and others suggest the direction in which the connection end-surface of an optical fiber connector is polished against the abrasive film surface strongly affects quality.

FIG. 1A is a schematic diagram showing a conventional polishing device in which a polishing disc 1 is turned on its own axis (this type of movement will be hereinafter referred to as "turning"), and in which an optical fiber connector 2 whose connection end-surface is to be polished is supported by a rotating arm 3.

In the example shown, the polishing disc 1, supporting a polishing medium, is turned around a center 0.

The optical fiber 2 whose connection end-surface is to be polished is attached to the tip end of the rotating arm 3, which makes a reciprocating movement in the direction indicated by the arrows.

Where this relative movement is utilized, the polishing is only effected in the turning direction of the polishing disc 1 and the rotating direction of the arm 3.

As a result, the polished surface is subject, as shown in FIG. 1B, to flaws owing to the turning of the polishing disc 1 and the reciprocating movement of the arm 3.

With a view to eliminating this problem, a polishing method was contrived in which, as shown in FIG. 2A, the connection 2 end-surface of an optical fiber connector is fixed at a point, with the polishing disc 1 being revolved around a point 0 with a turning radius R (this type of movement will be hereinafter referred to as "revolving"), thereby effecting polishing.

This method allows the connection end-surface of an optical fiber connector to be polished in all directions, as shown in FIG. 2B.

Accordingly, if the connection end-surface receives a flaw in one polishing direction, a subsequent polishing in another direction will efface it, thus making it possible to easily obtain a better polished surface than in the previously described example.

Apart from this, the inventor of the present invention filed a patent application titled "An Optical Fiber End-Surface Polishing Device" (Japanese patent application No. 62-135880). This application was also filed in the United States, claiming the Japanese priority (U.S. Ser. No. 07/172,322), and is now U.S. Pat. No. 4,831,784.

In the device according to these applications, the optical fiber end-surface is revolved while describing a relatively small circle, and the polishing disc is turned in a large circle.

As stated above, the rotating arm system shown in FIG. 1A is defective in polishing quality.

The device shown in FIG. 2A will yield better results than that of FIG. 1A. However, this system, in which the polishing plate 1 is revolved, is intended only for the polishing of the connection end-surface of a single optical fiber connector, so that it is not suited for mass production.

A more serious defect of this type of device is that, although its polishing disc is adapted to make a revolution, it is equipped with no mechanism for turning on its own axis. As a result, the connection end-surface of the optical fiber connector is moved only along the same polishing locus T, so that the abrasive film is soon worn out and pierced with holes, losing its polishing ability.

It is understood that the polishing of the connection end-surface of an optical fiber connector must always be performed with a new abrasive film surface. As stated above, a device in which the polishing disc only makes a revolution and is not turned on its own axis (FIGS. 2A and 2B) involves rapid deterioration of the abrasive film. Moreover, the system in which the connection end-surface to be polished moves repeatedly along the same locus on the abrasive film is disadvantageous not only in polishing quality but also in cost.

The optical fiber end-surface polishing device proposed by the inventor of the present invention operates in a more efficient and more stable manner than the above-described two conventional examples. However, the device is not without its problems. That is, since its polishing disc only turns around on its axis and the component supporting the optical fiber makes a movement corresponding to the revolution, the polishing quality fluctuates depending on the mounting position of the optical fiber.

That is, the polishing quality in some portions of an optical fiber end-surface is, in all probability, defective when compared to that in other portions thereof.

It is accordingly a principal object of this invention to provide an optical fiber end-surface polishing device in which the above-mentioned problems are eliminated with a simple mechanism.

A more specific object of this invention is to provide an optical fiber end-surface polishing device in which the mechanisms for revolution and turning are concentrated on the side of the polishing disc assembly, and in which mechanisms for correctly rubbing the optical fiber end-surface against the abrasive film surface are concentrated on the side where the optical fiber is supported, thereby making it possible to polish a large quantity of optical fibers with high quality.

SUMMARY OF THE INVENTION

In order to achieve the above objects, this invention provides an optical fiber end-surface polishing device comprising a polishing disc assembly (PA) adapted to make a polishing disc turn on its own axis (turning) and revolve around some other axis revolving with respect to a base supporting a polishing member, and an optical fiber holder assembly (HA) adapted to support an optical fiber holder section (H) for holding a plurality of optical fibers, the optical fiber holder assembly (HA) being supported in such a manner that the end surfaces of the optical fibers abut against the polishing member while being biased in a direction perpendicular thereto.

The optical fiber holder assembly (HA) comprises an optical fiber holder section (H) having a disc which is equipped with a plurality of optical fiber connector attaching sections to which optical fibers to be polished are attached, a supporting arm (A) for positioning the optical fiber holder section (H) with respect to the base, and a pressurizing shaft (S) suspended from the supporting arm (A) and adapted to bias the end surfaces of the optical fibers that are to be polished in a direction perpendicular to the polishing member.

The polishing disc assembly (PA) comprises a turning motor for effecting the turning, a revolution motor for effecting the revolving, a turning disc adapted to turn around its axis of rotation, a plurality of eccentric discs arranged on the turning disc at positions equally spaced from the axis of rotation of the turning disc and having respective eccentric connecting sections with the same eccentricity amount, a planetary gear mechanism adapted to transmit the torque of the revolution motor to the eccentric discs and to drive the eccentric connecting section in the same phase, and a polishing disc supporting a polishing medium and connected with the eccentric connecting sections so as to turn and revolve.

DESCRIPTION OF THE PREFERRED EMBODIMENTS

An embodiment of the optical fiber end-surface polishing device of this invention will now be described in detail with reference to the accompanying drawings.

Figure 1A:
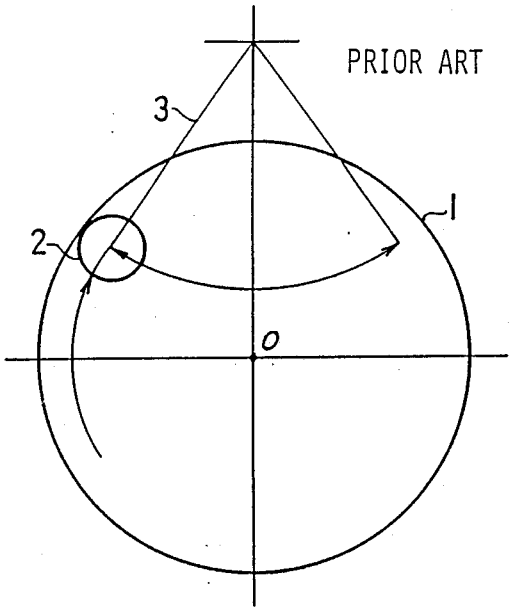
FIG. 1A is a schematic diagram showing a conventional polishing device of the type in which the polishing disc is turned on its own axis.
Figure 1B:
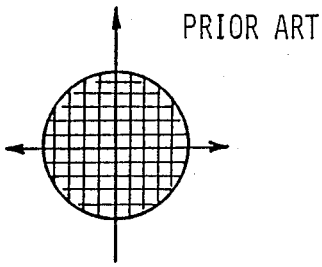
FIG. 1B is a schematic diagram of an optical fiber end-surface illustrating the polishing results obtained with the device shown in FIG. 1A.
Figure 2A:
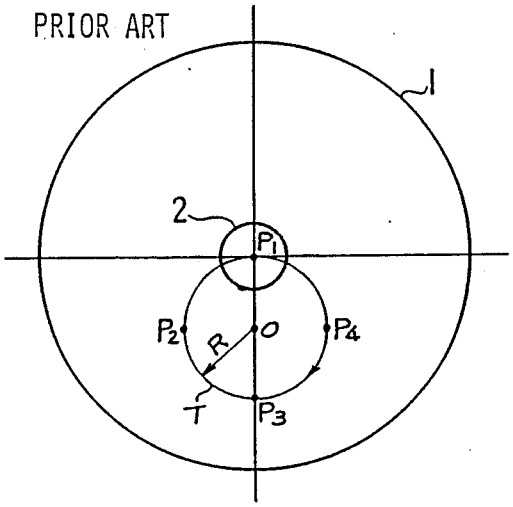
FIG. 2A is a schematic diagram showing a conventional polishing device of the type in which the polishing disc makes a revolution.
Figure 2B:
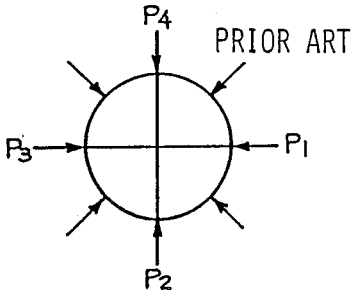
FIG. 2B is a schematic diagram of an optical fiber end-surface illustrating the polishing results obtained with the device shown in FIG. 2A.
Figure 3A:
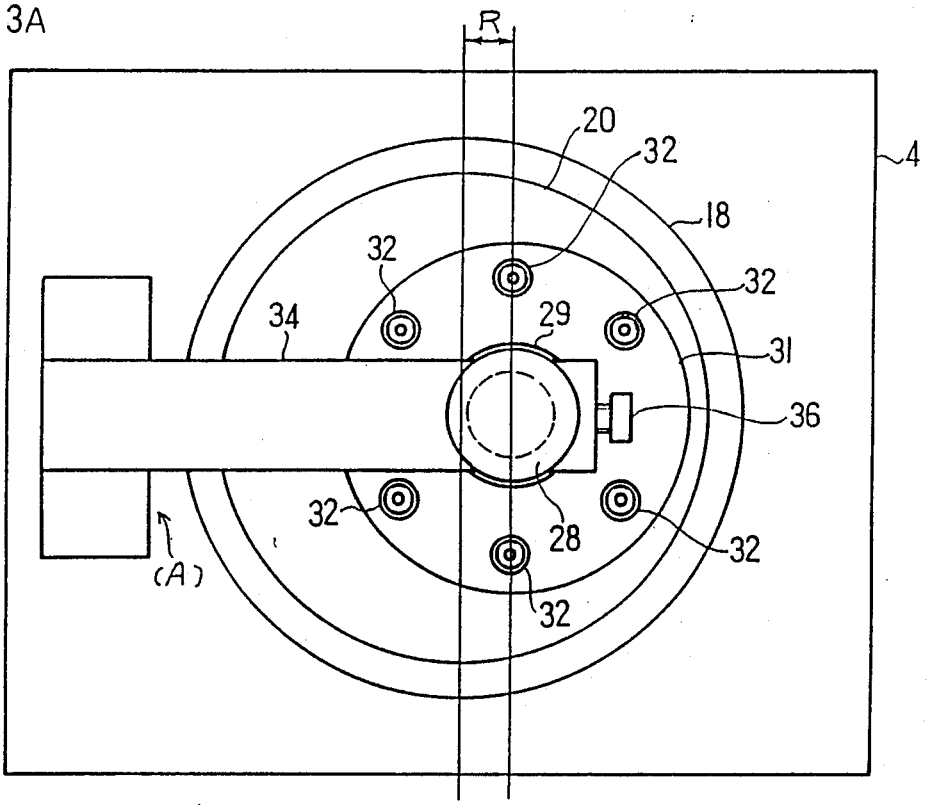
FIG. 3A is a plan view of an optical fiber end-surface polishing device in accordance with an embodiment of this invention.
Figure 3B:
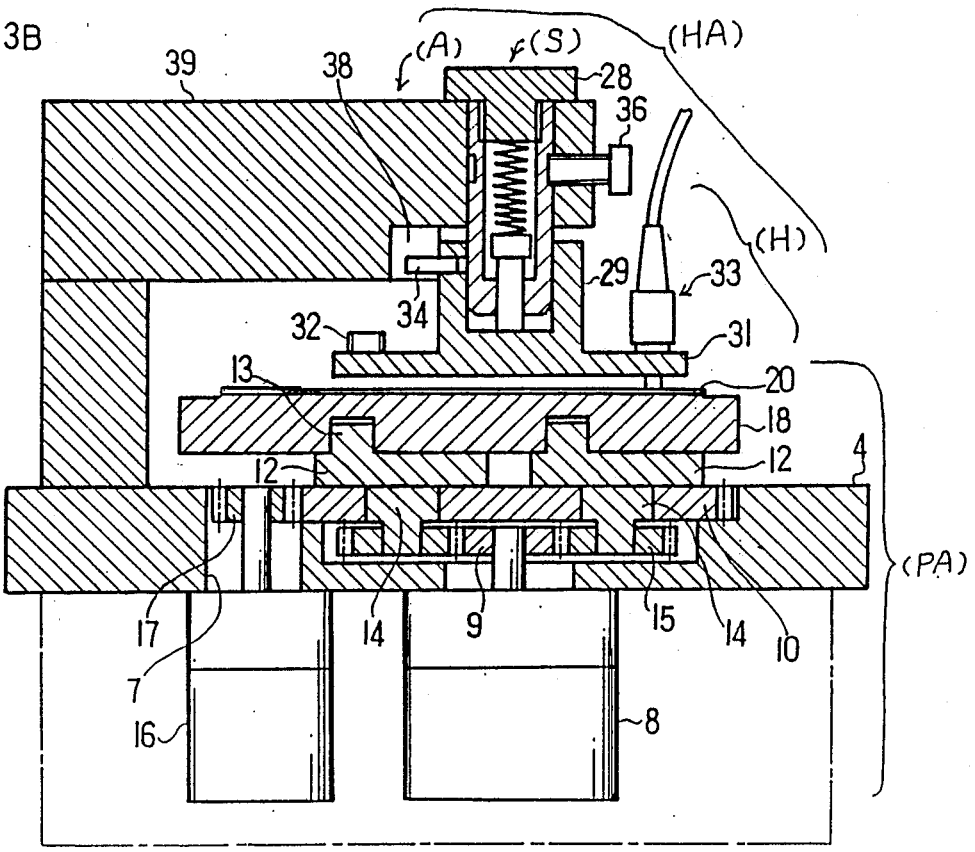
FIG. 3B is a sectional elevational view of the optical fiber end-surface polishing device shown in FIG. 3A.

As shown in FIGS. 3A and 3B, the embodiment of the optical fiber end-surface polishing device in accordance with this invention fundamentally consists of: a polishing disc assembly (PA) adapted to turn and to revolve a polishing disc 18 supporting a polishing member 20 with respect to a base 4, and an optical fiber holder assembly (HA) adapted to support on optical fiber holder section (H) for holding a plurality of optical fibers in such a manner that the respective end-surfaces of the optical fibers are pressed against the polishing member in a direction perpendicular thereto.

The optical fiber holder assembly (HA) consists of the optical fiber holder section (H) having a disc 31 which includes a plurality of optical fiber connector attaching sections 32 for connecting optical fibers to be polished, a supporting arm (A) for positioning the optical fiber holder section (H) with respect to the base 4, and a pressurizing shaft (S) suspended from the supporting arm (A) and biasing the end surface of the optical fibers to be polished in a direction perpendicular to the polishing member 20.

The base 4 of the polishing device includes a two-stepped cylindrical counterbore 5 (see FIG. 4C) having at the center of its bottom a through-hole 6. Another through-hole 7 having a relatively small diameter is provided in the base 4 in a section partly joining the outer edge of the two-stepped cylindrical counterbore 5.

A revolution motor 8 having a built-in speed-reduction mechanism is arranged in such a manner that its output shaft is in alignment with the bottom center of the two-stepped cylindrical counterbore 5 in the base 4 of the polishing device.

A driving gear 9 is fixed to the shaft end of this revolution motor 8, which is fixed in position in such a manner that its axis is in alignment with the center of the through-hole 6.

A turning disc 10 which includes a disc gear is prepared. Provided in this turning disc 10 are three through-holes 11 which are situated at positions equally spaced from the center of the turning disc 10 (see FIG. 4C).

Figure 4A:
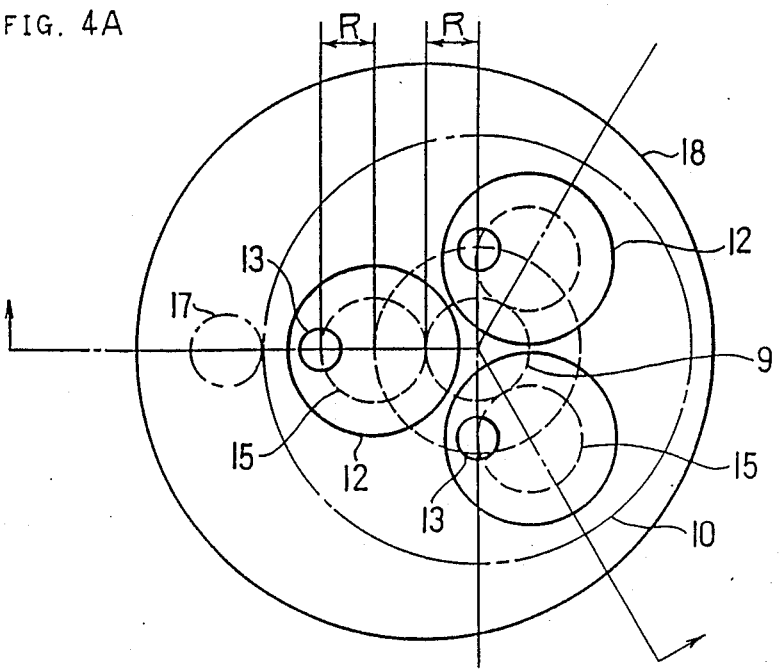
FIG. 4A is a schematic plan view illustrating the principle of driving the polishing disc in the optical fiber end-surface polishing device of this invention.
Figure 4B:
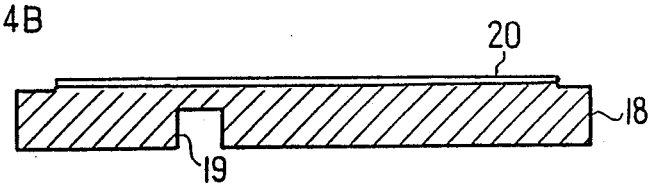
FIG. 4B is a sectional elevational view of the polishing disc in the optical fiber end-surface polishing device.
Figure 4C:
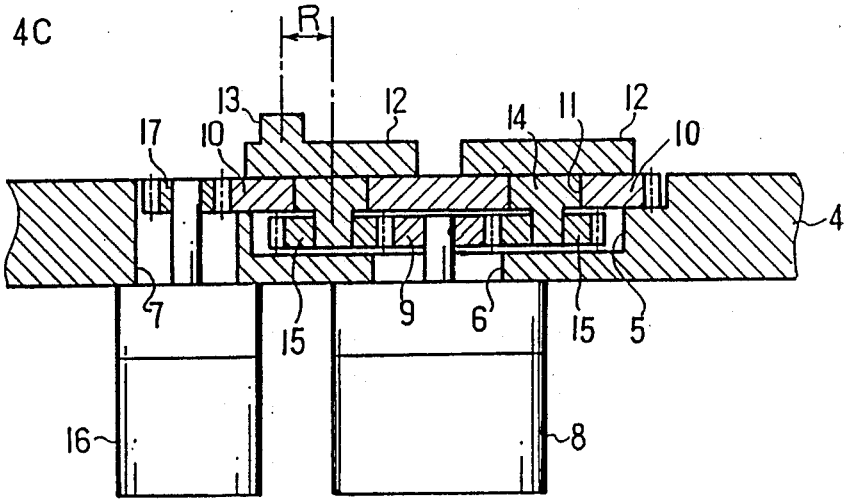
FIG. 4C is a sectional elevational view of the polishing-disc driving mechanism of the optical fiber end-surface polishing device.

An eccentric disc 12 is provided for each of these through-holes 11 (see FIGS. 3B, 4A and 4C). Each eccentric disc 12 has an eccentric axle 13 at a position removed from the center of the corresponding eccentric disc 12 by a distance equal to the radius R thereof.

The eccentric discs 12 have respective axle sections 14 which are inserted into the respective through-holes 11 of the turning disc 10 and rotatably supported therein.

Provided respectively on these axle sections 14 are three planetary gears 15 are in mesh with the driving gear 9 driven by the above-mentioned revolution motor 8.

After being equipped with the above-mentioned components, the turning disc 10 is inserted into the two-stepped cylindrical counterbore 5 and is supported on the upper step thereof.

The polishing device further includes a turning motor 16 which is also equipped with a built-in speed-reduction mechanism. The turning motor 16 is fixed in a position in alignment with the through-hole 7 provided in the base 4, and has at the tip end of its output shaft a driving gear 17 which is in mesh with a gear provided around the outer periphery of the turning disc 10.

As shown in FIG. 4B, provided on the lower side of the polishing disc 18 of this device are blind holes 19 into which the above-mentioned eccentric shafts 13 are inserted and wherein they are rotatably supported. An abrasive film which constitutes the polishing member 20 is bonded to the upper surface of the polishing disc 18.

The base 4 constitutes the core component of the polishing disc assembly (PA) of this embodiment. The turning motor 16 for supplying rotative power to turn the polishing disc 18 and the revolution motor 8 for supplying rotative power to revolve the polishing disc 18 are fixed to the base 4.

The turning disc 10 is made to turn around its own axis of rotation by the turning motor 16.

The eccentric discs 12 are arranged on the turning disc 10 at respective positions equally spaced from the center of the disc 10 in such a manner as to be rotatable with respect to this disc 10, each of the eccentric discs 12 having an eccentric connecting section.

Each eccentric connecting section is formed by one of the eccentric axles 13 provided on the eccentric discs 12 and by one of the blind holes 19 provided in the polishing disc 18. The planetary gear mechanism 9, 15, 14 transmits the torque of the revolution motor 8 to each of the eccentric discs 12, driving the eccentric connecting sections in the same phase.

The polishing disc 18, supporting the polishing medium 20, is connected to the eccentric connecting sections and is made to undergo both turning and revolving.

Next, the optical fiber holder assembly (HA) which faces the polishing disc assembly (PA) will be described.

Figure 5A:
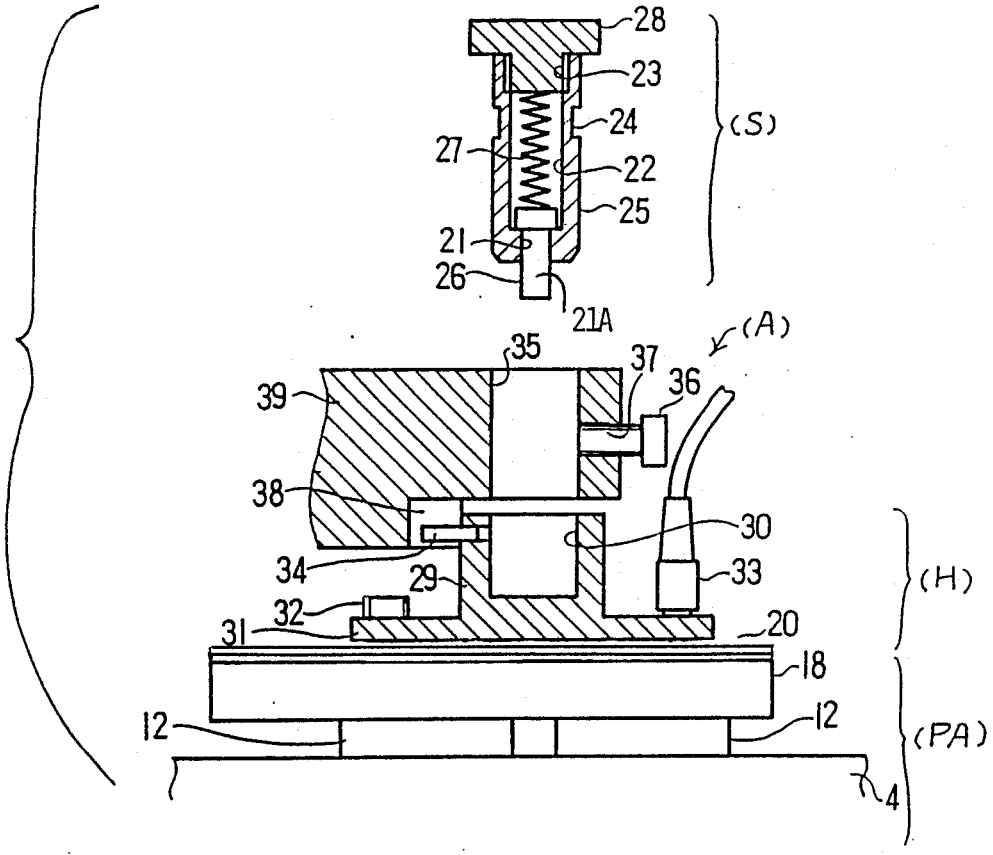
FIG. 5A is a sectional elevational view showing a supporting arm (A), a pressurizing shaft (S), and an optical fiber holder assembly (HA) in this embodiment before they are connected to each other.
Figure 5B:
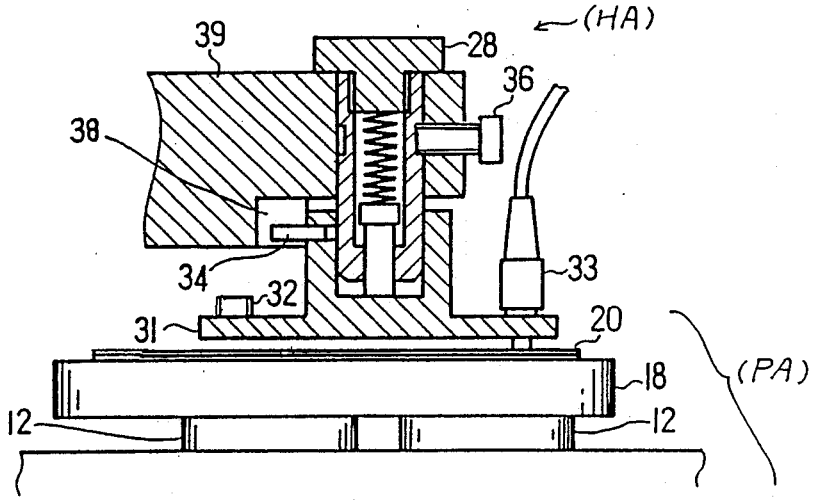
FIG. 5B is a sectional elevational view showing the supporting arm, the pressurizing shaft, and the optical fiber holder disc of this embodiment when they are connected to each other.

FIGS. 5A and 5B are sectional elevational views showing the construction of the optical fiber holder assembly (HA).

FIG. 5A shows the optical fiber holder assembly (HA) before it is assembled, and FIG. 5B shows the optical fiber holder assembly (HA) after it is assembled and placed in the polishing condition.

The assembly (HA) includes a supporting arm (A) 39 whose base section is fixed to the base 4 of the polishing device.

Provided in the end section of the supporting arm (A) 39 are a through-hole 35 adapted to receive the pressurizing shaft (S) with precision and a screw hole 37 adapted to receive a fixing bolt 36 for fixing the pressurizing shaft (S) received in the through-hole 35.

The optical fiber holder section (H) includes a stopper pin 34 which engages with a U-shaped groove 38 provided on the bottom surface side of the supporting arm (A) 39.

The optical fiber holder section (H) consists of a cylindrical connecting section 29 having at its center a cylindrical counterbore 30 and a disc section 31 which includes on its outer concentric periphery a plurality of optical connector attaching sections 32.

The above-mentioned stopper pin 34 is provided on the cylindrical connecting section 29 which is at the center of the optical fiber holder section (H) and which includes the cylindrical counterbore 30, the stopper pin 34 being engaged with the stopper groove 38 of the supporting arm (A) 39 in such a manner as to be movable in the vertical direction but restricted in its rotation.

As stated above, the boss-like cylindrical section 29, provided at the center of the optical fiber holder section (H), includes the cylindrical counterbore 30. The disc section 31, provided around the cylindrical section 29, includes a plurality of optical fiber connector attaching sections 32 arranged on the concentric outer periphery of the disc section 31.

Although a plurality of optical fiber connectors 33 are normally attached to the respective optical fiber connector attaching sections 32, the drawings show a condition in which only one optical fiber connector 33 is attached to one of the optical fiber connector attaching sections 32.

The pressurizing shaft (S) includes a cylindrical member 25 which has an outer peripheral cylindrical section adapted to be fitted with precision into the cylindrical counterbore 30 in the optical fiber holder section (H) and into the through-hole 35 provided in the supporting arm (A) 39. This outer peripheral cylindrical section of the cylindrical member 25 is fixed to the supporting arm (A) 39 and is slidably connected with the cylindrical counterbore 30 of the optical fiber holder section (H). The pressurizing shaft (S) also includes a shouldered cylindrical hole 22 which has at its lower end a through-hole 21 having a relatively small diameter.

The pressurizing shaft (S) further includes a groove 24 provided on the outer peripheral cylindrical section 25 thereof.

Provided in the cylindrical hole 22 of the cylindrical member 25 are a pressing pin **21*a* slidably fitted into the above-mentioned through-hole 21 of this cylindrical hole 22 and a biasing means for biasing this pressing pin 21*a* downwards. The biasing means includes a coil spring 27 inserted into the cylindrical hole 22 and positioned over the pressing pin 21*a* and a pressure adjusting bolt 28 which is engaged with a female screw 23 provided in the upper opening section of the cylindrical hole 22 and which is adapted to compress the coil spring 27. The degree of compression can be adjusted by changing the vertical position of the pressure adjusting bolt 28**, which is effected by rotating the same.

The pressurizing shaft (S) is passed through the through-hole 35 of the supporting arm 39 and inserted into the cylindrical counterbore 30 of the boss-like cylindrical section 29 at the center of the optical fiber holder section (H).

The pressing pin **21*a* includes a shouldered-pin section 26. When the pressurizing shaft (S) is further pressed in after this shouldered-section 26 has touched the bottom surface of the cylindrical counterbore 30, the coil spring 27 is deformed by the compressing force, thereby exerting, through the tip end of the shouldered-pin section 26**, the required polishing pressure on the optical fiber end surface to be polished.

Next, the operation of the polishing disc 18 during polishing will be described with reference to FIGS. 3A, 3B and 4A.

First, when the revolution motor 8 starts to operate, the plurality of planetary gears 15 rotatably mounted on the turning disc 10 are caused, through the driving gear 9, to make a synchronous rotation.

The eccentric axles 13 which are mounted on the respective eccentric discs 12 integrally rotated around the same axis with the respective planetary gears 15 make a synchronized rotation along the respective loci with the rotating radius R.

The torque of the turning motor 16 is transmitted through the driving shaft 17 provided on the output shaft thereof to the outer peripheral gear of the turning disc 10, causing the turning disc 10 to turn on its own axis at a very low speed.

By virtue of this arrangement, the polishing disc 10 turns on its own axis as it performs a revolution.

The polishing locus of the optical fiber connector end surface is changed at each revolution by the turning angle.

The speed ration between the rotating section must be determined by taking into account the size of the abrasive film, the amount of eccentricity, the number of optical fiber connectors attached, and the like.

It may be mentioned, by way of example, that the inventor of this invention obtained a very satisfactory polishing result under the following conditions: polishing member: an abrasive film having a diameter of 120 mm; eccentricity amount: 17 mm; number of optical fiber connectors attached: 12 to 16; speed ratio: 0.5 to 1.2 turns for every 100 revolutions.

As described above, the optical fiber end-surface polishing device of this invention comprises a polishing disc assembly (PA) adapted to make a polishing disc assembly turn on its own axis and to revolve around some other axis with respect to a base supporting a polishing member, and an optical fiber holder assembly (HA) adapted to support an optical fiber holder section (H) for holding a plurality of optical fibers, the optical fiber holder section (H) being supported in such a manner that the end surfaces to be polished of the above-mentioned optical fibers abut against the above-mentioned polishing member while being biased in a direction perpendicular thereto.

Thus, polishing can be carried out while simultaneously holding a number of optical fiber connectors with precision by means of the optical fiber holder section (H).

Given that the polishing disc assembly (PA) supporting a polishing member can effect a combined movement of revolving and turning simultaneously and synchronously by means of a simple mechanism, all the problems experienced with conventional polishing discs owing to their movement can be eliminated.

Thus, the above-mentioned problem of the polishing quality fluctuating depending on the holding position has been overcome.

The device of this invention makes it possible to produce a large number of optical fiber connectors with excellent polishing quality.

As it allows the polishing film to enjoy a substantially longer service life than in the conventional devices, the device is very advantageous from an economics point of view.

What is claimed is:

1. An optical fiber end-surface polishing device comprising a polishing disc assembly including means for rotating a polishing disc on its own axis; and means for revolving said polishing disc around another axis with respect to a base, said polishing disc supporting a polishing member; and an optical fiber holder assembly including an optical fiber holder section for holding a plurality of optical fibers; and means for supporting said optical fiber holder section so that the end surfaces of said optical fibers abut against said polishing member while being biased in a direction perpendicular to a surface thereof.

2. An optical fiber end-surface polishing device as claimed in claim 1, wherein said rotating means comprises a turning motor, said revolving means comprises a revolution motor; and said polishing disc assembly further includes a turning disc rotatable around its axis of rotation by said turning motor;

a plurality of eccentric discs arranged on said turning disc at positions equally spaced from said axis of rotation of said turning disc and having respective eccentric connecting sections each having the same eccentricity amount, said eccentric connecting sections supporting said polishing disc for the rotation and revolution thereof; and a planetary gear mechanism for transmitting the torque of said revolution motor to said plurality of eccentric discs, said planetary gear mechanism driving each said eccentric connecting section in the same phase.

3. An optical fiber end-surface polishing device as claimed in claim 2, wherein said eccentric connecting sections include eccentric axles respectively provided on said eccentric discs, and wherein said polishing disc has bearing holes for receiving said eccentric axles.

4. An optical fiber end-surface polishing device as claimed in claim 1, wherein said optical fiber holder section includes a disc section having a plurality of optical fiber connector attaching sections to which the optical fibers to be polished are attached; and said supporting means includes a supporting arm for positioning said optical fiber holder section with respect to said base, and a pressurizing shaft suspended from said supporting arm for biasing the end surfaces to be polished of said optical fibers in a direction perpendicular to a surface of said polishing member.

5. An optical fiber end-surface polishing device as claimed in claim 4, wherein said optical fiber holder section further comprises a cylindrical connecting section having at its center a cylindrical counterbore, and said disc section has on a concentric circle on its outer edge section said plurality of optical connector attaching sections.

6. An optical fiber end-surface polishing device as claimed in claim 5, wherein said cylindrical connecting section of said optical fiber holder section includes a stopper pin engaged with a stopper groove on said supporting arm for allowing movement of said cylindrical connecting section in the vertical direction and restricting rotational movement.

7. An optical fiber end-surface polishing device as claimed in claim 5, wherein said pressurizing shaft comprises a cylindrical member having an outer peripheral cylindrical section fitting with precision into the cylindrical counterbore of said optical fiber holder section and into a through-hole provided in said supporting arm, said cylindrical member being fixed to said supporting arm and slidably connected with said optical fiber holder section, a cylindrical hole having at its bottom end a through-hole with a relatively small diameter being defined in said cylindrical member and a groove being provided in said outer peripheral cylindrical section of said cylindrical member; a pressing pin provided in said cylindrical hole of said cylindrical member and slidably inserted into said through-hole for engaging and depressing said optical fiber holder section, said biasing means biasing said pressing pin downwards.

8. An optical fiber end-surface polishing device as claimed in claim 7, wherein said supporting means comprises biasing means including a coil spring inserted into said cylindrical hole and positioned over said pressing pin for biasing said pressure pin downward, and a pressure adjusting bolt engaged with a female screw provided in an upper opening section of said cylindrical hole for compressing said coil spring.

9. An optical fiber end-surface polishing device comprising:

a polishing disc assembly including:
- a base;
- a polishing member supported by said base;
- a polishing disc; and
- drive means rotating said polishing disc about a first axis relative to said base and revolving said polishing disc around a second axis relative to said base, said first axis being spaced from said second axis; and an optical fiber holder assembly including:
- an optical fiber holder section; and
- supporting and biasing means holding a plurality of optical fibers having end surfaces, said supporting and biasing means orienting and biasing the end surfaces of the plurality of optical fibers substantially perpendicular to and against said polishing member.

10. A device as claimed in claim 9, wherein said drive means comprises

- a turning motor for rotating said polishing disc;
- a revolution motor for revolving said polishing disc;
- a turning disc having an axis of rotation, said turning disc being rotatable about its axis of rotation by said turning motor;
- a plurality of eccentric discs disposed on said turning disc and supporting said polishing disc, said eccentric discs being equally spaced from the axis of rotation of said turning disc;
- an eccentric connecting section disposed on each said turning disc, each said eccentric connecting section having substantially equal eccentricities;
- a planetary gear mechanism for transmitting the torque of said revolution motor to said plurality of eccentric discs and for driving each said eccentric connecting section in the same phase; and
- a polishing medium disposed on said polishing disc.

11. A device as claimed in claim 10, further comprising means defining a plurality of bearing holes in said polishing disc, each said eccentric connecting section including an eccentric axle on each said eccentric disc disposed in a respective one of said plurality of bearing holes.

12. A device as claimed in claim 9, wherein said optical fiber holding section includes a disc section, said supporting and biasing means includes a plurality of optical fiber connector attaching sections disposed on said disc section for attaching the optical fibers to be polished, and said supporting and biasing means includes a supporting arm for positioning said optical fiber holder section with respect to said base and includes a pressurizing shaft suspended from said supporting arm.

13. A device as claimed in claim 12, wherein said optical fiber holding section includes a cylindrical connecting section, a cylindrical counterbore being defined in said cylindrical connecting section; and said plurality of optical fiber connector attaching sections are disposed on a concentric circle adjacent to an outer edge of said disc section.

14. A device as claimed in claim 13, further comprising means defining a stopper groove in said supporting arm, and wherein said cylindrical connecting section includes a stopper pin engaging with said stopper groove for allowing vertical movement of and for restricting rotational movement of said cylindrical connecting section.

15. A device as claimed in claim 13, wherein said pressurizing shaft includes a cylindrical member fixed to said supporting arm, said cylindrical member having an outer peripheral cylindrical section for being slidably received in the cylindrical counterbore of said optical fiber holder section and in a through-hole provided in said supporting arm, and wherein a cylindrical hole having at its bottom end a through-hole with a relatively small diameter is defined in said cylindrical member, a groove is provided in said outer peripheral cylindrical section of said cylindrical member, and said supporting and biasing means includes a pressing pin disposed in said cylindrical hole of said cylindrical member and slidably received in said through-hole for engaging and depressing said optical fiber holder section.

16. A device as claimed in claim 15, wherein said supporting and biasing means includes a coil spring for biasing said pressing pin downwards, said coil spring is inserted in said cylindrical hole and positioned over said pressing pin, and said supporting and biasing means includes a pressure adjusting bolt for adjustably compressing said coil spring.

* * * * *